United States Patent [19]

Courtoise

[11] Patent Number: 4,867,602

[45] Date of Patent: Sep. 19, 1989

[54] ATTACHMENT FOR CLEANING AND REFACING CONCRETE JOINTS

[76] Inventor: Robert L. Courtoise, 1309 Ninth St., Cottage Hills, Ill. 62018

[21] Appl. No.: 208,229

[22] Filed: Jun. 17, 1988

[51] Int. Cl.[4] ..... E01C 23/09

[52] U.S. Cl. ..... 404/87; 299/36

[58] Field of Search ..... 404/74, 87, 89, 90; 172/711; 299/36, 38, 39, 85; 15/93 R, 236.01, 236.08; 83/928

[56] References Cited

U.S. PATENT DOCUMENTS

| | | | |
|---|---|---|---|
| 1,404,380 | 1/1922 | Erter | 172/464 X |
| 2,541,309 | 2/1951 | Trail | 404/87 X |
| 2,584,993 | 2/1952 | Eder | 299/36 |
| 3,041,753 | 7/1962 | Koloseus | 172/711 X |
| 3,347,597 | 10/1967 | Holifield | 404/87 X |
| 3,791,696 | 2/1974 | Riley | 404/74 X |
| 4,171,849 | 10/1979 | Jacobsen et al. | 404/87 X |
| 4,762,371 | 8/1988 | Lupton | 299/39 |
| 4,778,304 | 10/1988 | Baldi et al. | 404/87 |

FOREIGN PATENT DOCUMENTS

| | | | |
|---|---|---|---|
| 1133589 | 7/1962 | Fed. Rep. of Germany | 172/125 |
| 3033305 | 4/1982 | Fed. Rep. of Germany | 404/87 |
| 3634630 | 4/1988 | Fed. Rep. of Germany | 404/87 |
| 295638 | 7/1929 | United Kingdom | 172/711 |

*Primary Examiner*—Jerome W. Massie, IV
*Assistant Examiner*—Matthew Smith
*Attorney, Agent, or Firm*—Paul M. Denk

[57] ABSTRACT

An attachment for cleaning and refacing concrete joints, being connectable with a tractor, or the like, incorporating a frame that is rigidly mounted to the vehicle chassis, incorporates a rearwardly extending brace, for supporting of a hydraulic or other cylinder. A torsion bar pivotally mounts through the frame, and is connected by a lever arm with the cylinder, so that the torsion bar, when the cylinder is rendered operative, can undertake a slight pivot, in one direction or the other. An arm supporting a cutting blade, through an integrally connected rearwardly disposed mount, pivotally connects with the frame, and a biasing arm coupled with the blade supporting arm, and is secured with the torsion bar, so that a turning of the torsion bar provides for major adjustments in the location of the cutting blade, with respect to the concrete joint to be cleaned, and during functioning of the apparatus, while refacing of a joint, the impacting forces encountered by the blade are absorbed by the torsion bar, in addition to furnishing its mount.

20 Claims, 3 Drawing Sheets

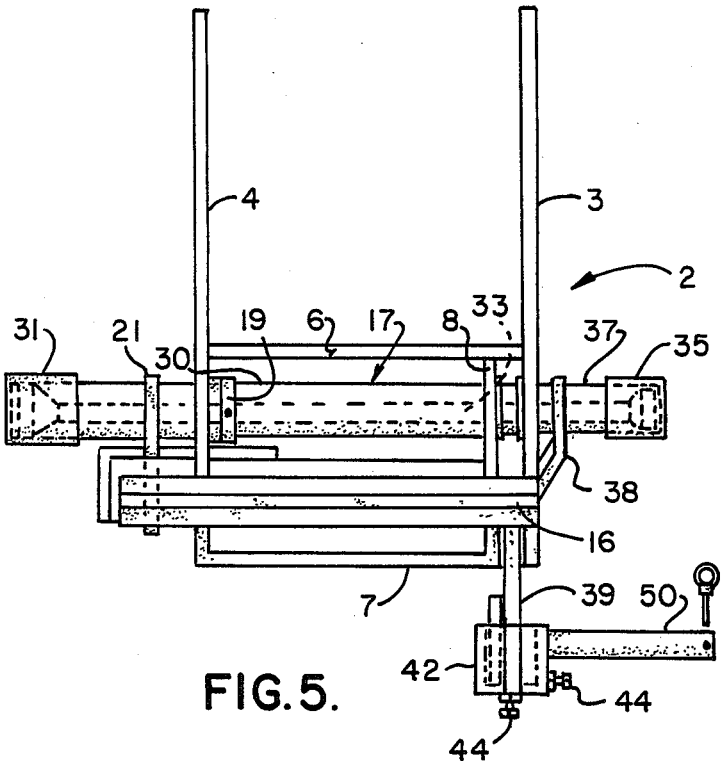
FIG. 5.
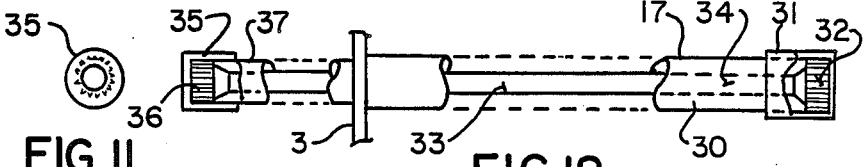
FIG. 11.
FIG. 12.
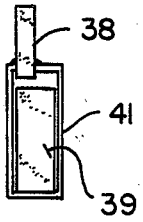
FIG. 13.
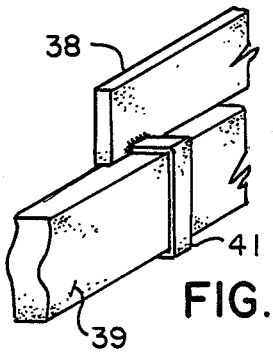
FIG. 14.
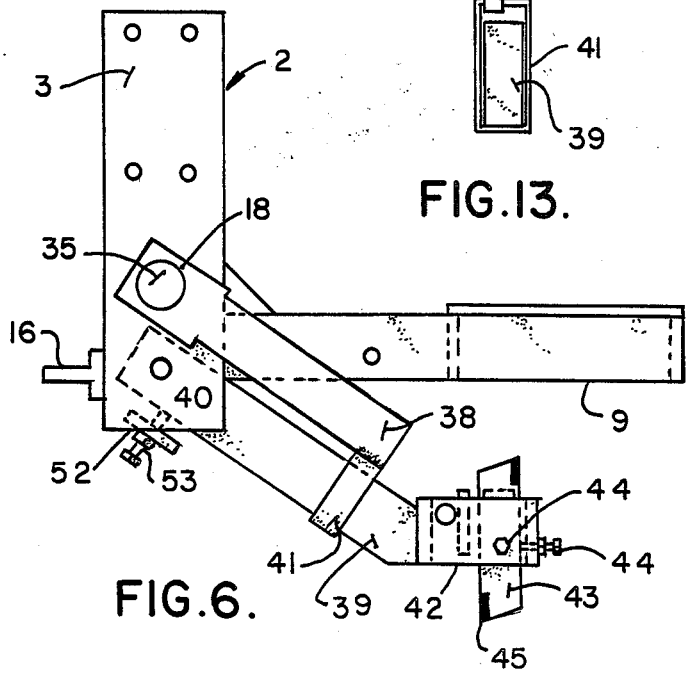
FIG. 6.
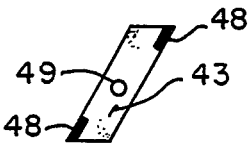
FIG. 15.

ATTACHMENT FOR CLEANING AND REFACING CONCRETE JOINTS

BACKGROUND OF THE INVENTION

This invention relates generally to an attachment for connection with a tractor, or other vehicle, and which is effective for removing prior asphaltic or other composition joint compound, from within concrete joints, while simultaneously refacing the joint in preparation for the installation of a fresh joint.

There have been available many attachments for use for cleaning pavement expansion joints, even going back many years, and the design and construction of such earlier embodiments are usually for application to some type of wheeled vehicle, in order to facilitate the usage of the attachment, during its application. For example, the United States patent to Erter, U.S. Pat. No. 1,404,380, discloses such an attachment for road rollers. As shown therein, it includes a form of attachment to a roller, which generally incorporates a variety of downwardly depending scarifying teeth, as supported at the back of a water tank provided upon the roller, and which included a series of arms, with the connected teeth being pivotal downwardly, into operative position by means of the functioning of its accompanying steam cylinder. Apparently this device was used in conjunction with a road roller, when the roads were being created, and would break up the surface of mud or other ground components while an early road was being formed. In any event, the concept of having one or more arms supported at the back end of a vehicle, and being supportive of a spike, or a plurality of the same, that may be lowered downwardly through the operations of a cylinder, is disclosed in this very early patent.

The patent to Berry, U.S. Pat. No. 1,473,003, shows a very similar type of scarifier, related to that as just previously explained, for connection to the back end of road machinery, and which was raised or lowered into operative position by means of the fluid pressure cylinder that accompanied its structure.

The patent to Benjamin, U.S. Pat. No. 2,358,298, shows another form of tractor mounted implement. As can be seen, a tractor is utilized in this instance, incorporating a series of rigs, and supporting the ground-working tools, which could be raised or lowered into position by means of the fluid pressure cylinders. This particular implement was also side mounted, to the tractor, as can be noted.

The United States to Trail, U.S. Pat. No. 2,541,309, shows what is related to the current invention, and it discloses a joint digger and cleaner for concrete pavements. The particular device, as disclosed, appears to b of interest to the current invention, because it apparently was side mounted to a prime mover, such as the tractor as shown, incorporates a side member that supports the cutting plate, and which can be raised or lowered by means of the operations of the shown cylinder. This device, nevertheless, discloses an instrument that incorporates related structure, and for use for cleaning out the filler material between conventional concrete sections of roads, air-strips, and the like, in preparation for their resealing.

The patent to Eder, U.S. Pat. No. 2,584,993, discloses another form of expansion joint cleaner, which in the particular instance as shown, mounted more forwardly of the tractor, at a lateral position, but being somewhat structured differently from the current invention.

The United States patent to Jackson, U.S. Pat. No. 2,984,471, shows a portable type of crack router.

The United States patent to Holifield, U.S. Pat. No. 3,347,597, discloses a jet cleaning apparatus and groove router for concrete pavements. This device is quite distinct from the current development, in that it utilizes a different type of machinery, and its routing device appears to function more in the nature of a skid carriage-like means, having a series of tools depending downwardly therefrom, for cleaning out concrete joints.

The United States patent to Norton, et al, U.S. Pat. No. 3,560,023, discloses another type of ground engaging implement, that is supported upon a tractor. This particular device incorporates a support structure that is adapted for attachment to a tractor, has pivotal connection therewith, which is rendered functional through the operations of a hydraulic ram, in order to impart a downward load to a support structure as when in engagement with the ground. The exact type of implement incorporated within the structure is not really described.

The United States patent to Reilly, U.S. Pat. No. 3,791,696, shows another form of expansion joint cleaning apparatus and method. This particular device, does incorporate an attachment for cleaning sealant filled joints within concrete structures forming airfield pavements, highways, floor slabs of buildings, and the like. The apparatus is for mounting upon a vehicle, it incorporates a tool carrying arm, and means mounting of the arm to the vehicle for its manipulation, with the cleaning tool being attached to the arm and capable of being lowered in operative position. It should also be noted that the tool itself incorporates a carbide tip, to provide it with greater strength.

The patent to Torazzi, U.S. Pat. No. 3,973,632, shows a form of ripper for tractors and similar vehicles. This particular device is an attachment to a tractor, that incorporates a pivot arm, and a variety of actuators, which are useful for disposing the rippers at various angles, and depths, through the operations of its said actuators.

Finally, the United States patent to Jacobson, U.S. Pat. No. 4,171,849, shows an apparatus for cleaning pavement expansion joints. But, this particular device may achieve the same results as the current development, but it incorporates entirely different type of carriage means, than the type as explained and defined in the particular patent, and which has specific utility as used in conjunction with its tool bit means, as disclosed.

SUMMARY OF THE INVENTION

It is the principal object of this invention to provide an attachment for cleaning and refacing concrete joints, and which has built in cushioning and resiliency through the application and installation of a torsion bar means or spring means within its structure, so that adequate pressure can be applied upon its tool during functioning, but at the same time, have reasonable give so as to prevent the spalling of concrete, the fracturing of the tool, and its various supports, or component structures of the attachment, generally through the functioning of its torsion bar means.

This invention contemplates the formation of an attachment to a tractor, or other vehicle, and for use for providing for its convenient adjustment, for raising or lowering of a tool into a concrete joint, and at the same time, incorporates inherent structure that facilitates the effective usage of the tool, and the overall attachment, during application.

The invention generally incorporates a frame means, of substantial structural strength and component parts, that is applied to the undercarriage of a tractor, or the like, incorporating a pair of upright arms, and a base frame, that are structurally bolted or otherwise attached directly to the chasis, or framework, of the tractor. The framework includes means for mounting of a torsion bar means therethrough, and which torsion bar means includes an outer cylinder, that is generally pivotally mounted within the framework structure, and has a torsion bar inserted therein, interlocked or connecting with its inwardly located end, so that resiliency can be added to the operative components of the attachment, through the functioning of the torsion bar, during the attachment's application. Extending rigidly and rearwardly from the frame means is a brace, that generally connects stationarily with the frame means, with the back end of the brace incorporating a coupling that is designed for ready connection of a hydraulic or other type of cylinder, or other prime mover, so that when the hydraulic or other cylinder is actuated, its opposite end, connecting with a lever arm, that secures integrally with the torsion means cylinder, can readily pivot the torsion means in one direction or the other, so as to facilitate a quick and prompt raising or lowering of the joint cutting blade or tool, and which maneuver can simply and easily can be performed by the tractor operator, independently Pin means holds the cylinder, and its cylinder rod, to their various components, and which pin means can be readily removed, when it is desired to take the cylinder from its connection within the attachment.

The torsion bar, at the opposite end of the torsion means cylinder, and which extends therefrom, includes a sleeve, at one end, and which sleeve has connected to it a biasing arm, which biasing arm obviously raises or lowers, depending upon the pivot provided to the torsion means, during its manipulation and functioning. Located downwardly from the biasing arm is arm means, that is pivotally connected to the frame means, and the rearward end of the biasing arm includes a coupling, that connects and supports the arm means, to effect its simultaneous raising or lowering with the said biasing arm, during its functioning, as aforesaid. The back end of the arm means includes a mounting means, and within which the cutting tool is secured, to provide for its raising or lowering into or out of the concrete expansion joint, during its application. The cutting tool may include a tungsten or carbide tip, or bit, in order to enhance its useful life. In addition, the mounting of the cutting blade within its mounting means may be accomplished through the adjustment of various bolts, and designed shims, for assuring that the cutting tool has proper location, in its setting and preparation for its usage. Furtheremore, there may be included a stub shaft of axle extending from the mounting means, and upon which a small wheel may locate, to provide, in conjunction with the depth setting provided for the cutting tool, a supplemental support for the arm means, in arranging its cutting tool within the expansion joint, in preparation for its digging out of the old joint compound, while it simultaneously refaces the joint in preparation for a subsequent installation of fresh joint compound.

In view of the foregoing, it is a principal object of the current invention to include structure fabricated into an attachment for a tractor, or the like, and which greatly facilitates the installation, adjustment, and usage of tool for application in preparing concrete expansion or other joints for fresh joint compound.

Still another object of this invention includes the installation of cylinder means, or motor means, within an attachment, and which can be readily operated by the single tractor operator, for quickly raising or lowering of a joint tool, to a desired depth, in preparation for its immediate usage.

Still another object of this invention includes the incorporation of torsion bar means, within the structure of an expansion joint removal tool, and which adds resiliency, buffering, and cushioning to the entire attachment, translated through its cutting tool, to assure its convenient and proper usage, and to prevent shattering and fracturing of the tool during normal installation and usage, or even when more abrupt and impacting obstacles or forces may be encountered during its application.

Still another object of this invention is to provide convenient means which may be employed by the operator for facilitating the manual insertion, installation, and proper adjustment within an expansion joint removal attachment.

These and other objects may become more apparent to those skilled in the art upon reviewing the subject matter of this disclosure, when considered in conjunction with the description of its preferred embodiment.

BRIEF DESCRIPTION OF THE DRAWINGS

In referring to the drawings,

FIG. 5 is a front elevational view thereof;

FIG. 6 is a left side view thereof;

FIG. 11 is a left end view of the torsion bar of this invention;

FIG. 12 is a partial side view of the torsion means, also shown through the broken away detail the internally arranged torsion b of this invention;

FIG. 13 is a end view of the compound biasing arm and arm means of invention;

FIG. 14 is an isometric view of the arms as disclosed in FIG. 13; and

FIG. 15 is a side view of a cutting blade or tool of this invention.

DESCRIPTION OF THE PREFERRED EMBODIMENT

Figure 1:
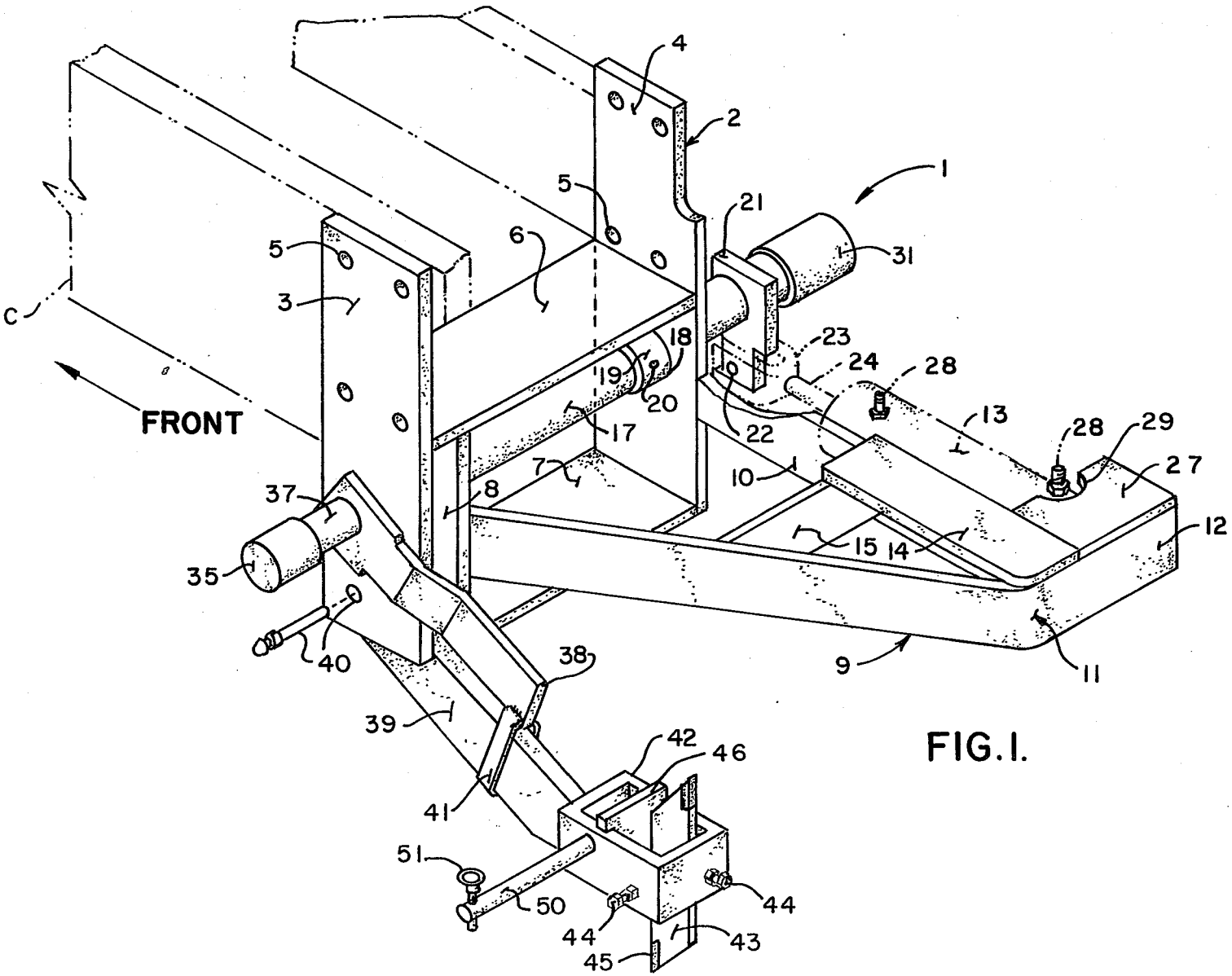
FIG. 1 is an isometric view of the attachment for cleaning and refacing concrete joints, showing mounting to the subframe or chasis of a tractor or the like, the latter type subframe being disclosed in phantom line.

In referring to the drawings, and in particular FIG. 1, the attachment 1 of this invention is clearly disclosed, and is normally mounted upon the chasis of a tractor, as at C, or of some other machinery, that provides it with its prime movement. The attachment includes a frame member 2, generally comprising of a pair of upright frames 3 and 4, and which are bolted, as can be seen at 5, to the chassis. The upright frames include a series of cross structures, as at 6 and 7, and which provide horizontal support for the frame means 2. Spanning vertically the space between the upper and lower cross structures 6 and 7 is a vertical support, as at 8, whose utility will be subsequently described. As can be seen, the foregoing components generally comprise the frame means of this invention, and provide rigid structural support for all of the operative components of this attachment, and structurally tie the same into the chassis of the wheeled vehicle, in which this instrument is used. Rigidly connected with the vertical support 8 is a rearwardly extending brace, as at 9, and which brace is arranged along a diagonal, and interconnects with a straight connecting brace 10, as at the junction approximately at 11, with both of said bracings being turned laterally, as at 12, to form a support for holding the actuation means, such as the hydraulic cylinder as shown at 13. Other reinforcing structure, as at 14 and 15, are disclosed for rigidifying the bracket structure. In any event, the bracket structure is rigidily secured with the frame means 2, for reasons to be subsequently described.

Figure 2:
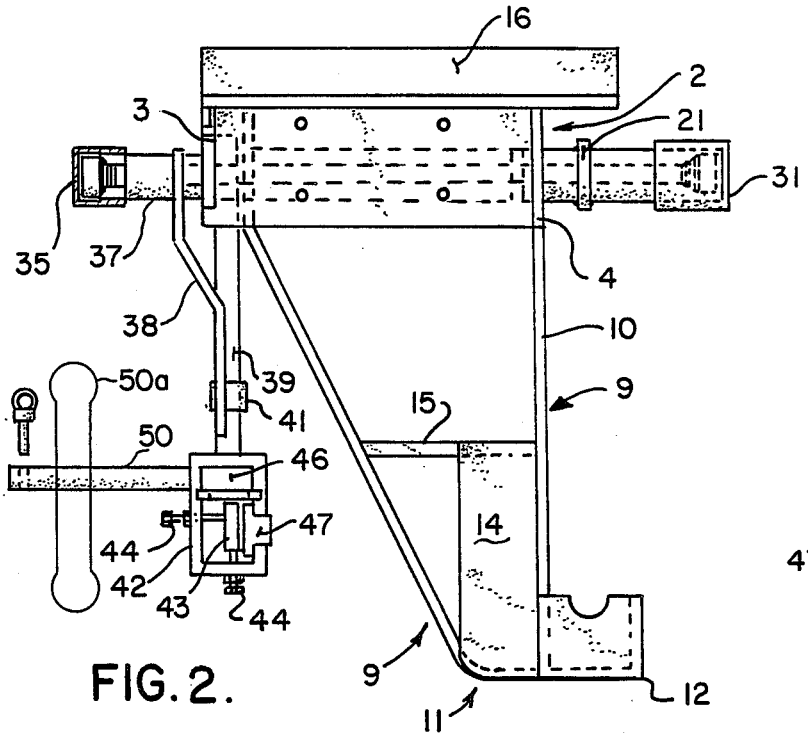
FIG. 2 is a plan view thereof.
Figure 9:
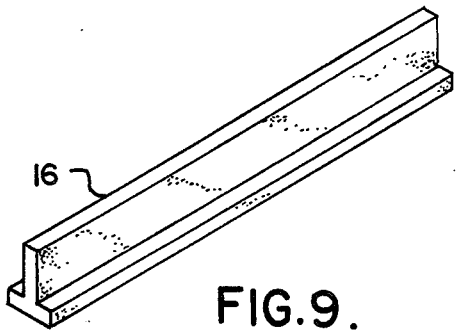
FIG. 9 is an isometric view of the structural reinforcing push bar that mounts to the lower end of the frame means.

As also disclosed in FIGS. 2 and 9, there is included a reinforcing push bar, as at 16, and which is mounted to the front of the frame means 2, for the purpose of providing further structural support at said location.

Pivotally mounted within the frame means 2 is the torsion means or spring means 17, and the torsion means is disposed through a pair of aligned apertures, as at 18, formed through the upstanding side frames 3 and 4, as can be noted. In addition, the torsion means 17 also extends through the vertical support 8, as shown. A sleeve, as at 19, locates the torsion means 17 into position with respect to its pivotal mounting within the frame means 2. A set screw, as at 20, positions the sleeve.

Figure 7:
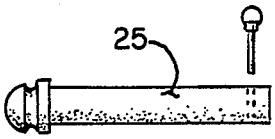
FIG. 7 discloses a locking pin useful for holding the hydraulic cylinder in place.
Figure 10:
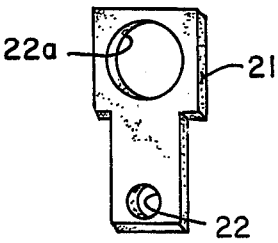
FIG. 10 is an isometric view of the lever arm of the invention.
Figure 4:
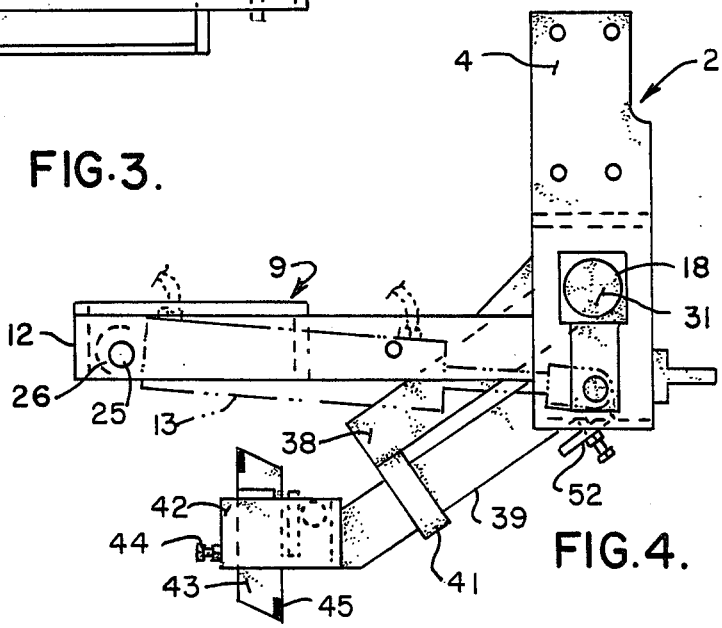
FIG. 4 is a right side view thereof.

Laterally of the frame means 2 there is provided, and rigidly secured as by welding, upon the torsion means 17, a lever arm 21. See also FIG. 10. This lever arm 21 includes a downwardly depending portion, as can be noted, and which has an aperture, as at 22, provided therethrough, and which is designed to be embraced by the clevis portion 23 of the cylinder rod 24 of the cylinder 13. The torsion means 17 fits through its aperture 22*a*. A positioning pin, such as the one shown in FIG. 7, at 25, can be located through the clevis and the aperture 22 for affixing that end of the hydraulic cylinder to the lever arm. The opposite end of the hydraulic cylinder 13, as can be seen in FIG. 4, includes an extending mount 26 that secures within the support 27, integrally formed of the turned end 12 of the brackets 9 and 10, and the cylinder, through its mount 26, can likewise be held into position by means, such as a fastening pin 25, similar to that as previously explained. As can be noted, the cylinder portion of the hydraulic cylinder 13 includes both inlet and outlets, generally as disclosed at 28, and through which hydraulic fluid flows, under pressure, for providing functioning to the cylinder, during its usage. As can be further noted, there may be clearance provided as at 29, within the support 27, to furnish clear access to these inlets and outlets 28, for attachment of their respective hydraulic or other pressure lines. In any event, as can be readily determined, upon actuation of the hydraulic cylinder 13, the lever arm 21 may be pivoted either slightly forwardly, or rearwardly, which resultingly attains a pivot to the torsion means 17, for purposes as will be subsequently described.

Furthermore, it should be noted that the cylinder 13, generally described herein as a hydraulic cylinder, may comprise any form of prime mover, whether it be a pneumatic cylinder, or even a motor means, useful for providing that degree of pivot required for the lever arm 21, when adjustment is desired for the torsion means 17, in preparation for the attachment to be used.

As can be seen in FIG. 12, the torsion means 17 includes an outer cylinder 30, and which has rigidly secured to one end, a cap, as at 31, which includes a series of internally arranged gear teeth, or an integral planet type gear, as at 32, and for reasons as to be described. Provided concentrically within the cylinder 30 is a torsion bar 33, or which may be a spring means, and which at its inwardmost end, as at 34, is fixably intergeared with the planet gear 32, so as to provide a rigid connection therein. But, as can be understood, because there is a geared connection at this location, the torsion bar could be slid laterally, out of the cylinder 30, when it is desired to replace the same. As previously explained, the cylinder 30, of the torsion means 17, rotatably mounts within the side frame 4, and likewise through the vertical support 8, and is positioned between these two components. On the other hand, the torsion bar 33 extends further laterally, to the opposite side, and through the side frame 3, to its end 35. At this location, as can be yet seen within FIG. 12, the end cap 35 includes an integral internally arranged planet gear, as at 36, and which interengages with the proximate geared end of the torsion bar 33. The end cap 35 further has an inwardly extending sleeve, as at 37, which extends likewise through the side frame 3, but which ends, as approximately at 37*a*, within the spacing between the side frame 3, and the vertical support 8. A stop means may be provided at said location to hold the sleeve 37 into position, and prevent its removal during usage of the attachment. Thus, as an be readily seen, the torsion bar functions to transmit twisting forces through its bar 33, within the cylinder 30, so as to add resiliency to the mounting of any cutting tool secured into this attachment, when readied for usage.

Rigidly mounting upon the sleeve 37 is a biasing arm 38, and it is through this arm 38 that the resiliency from the torsion means 17 is transmitted, through the attachment, and to its cutting blade.

Pivotally mounted to the side frame 3 is the arm means 39, such mounting occurring through the pivot pin 40, which generally spans the spacing between and is pivotally mounted within the side frame 3, and the vertical support 8. As can be noted, a coupler, as at 41, generally secures the approximate end of the biasing arm 38, to the pivotal arm means 39. Hence, when the torsion means 17 is pivoted, in either direction, through functioning of the cylinder 13, the biasing arm 38 will raise or lower, correspondingly, and effect a related pivot to the arm means 39.

Figure 8:
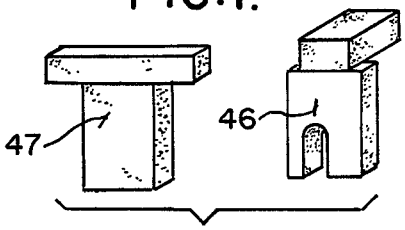
FIG. 8 is a compound view of a pair of shims useful for holding the cutting blade in operative and adjusted position.
Figure 3:
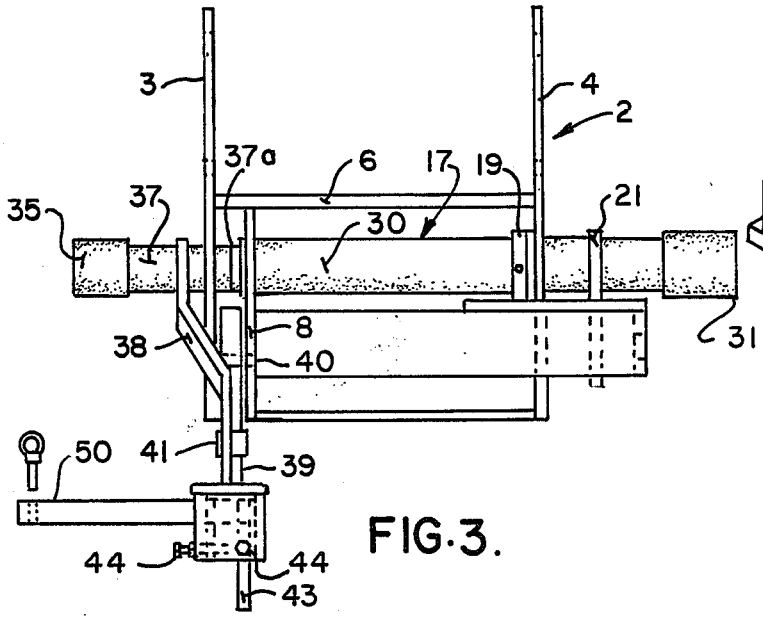
FIG. 3 is a back elevation view thereof.

Mounted proximate the rearward end of the arm means 39 is the mounting means 42. This mounting means, in the preferred embodiment, provides the means for securement of the cutting blade 43 into location This mounting means generally is configured as a rectangularly shaped frame, as can be seen, and incorporates a series of positioning bolts, as at 44, for tightly binding against the cutting blade, once it is positioned, to locate it, and particularly its downwardly positioned or located cutting tip portion, as at 45, as can be noted. In addition, various shims, as at 46 and 47, as disclosed in FIG. 8, in addition to FIG. 2, are located into position, either in front of, or also adjacent, the positioned cutting blade 43, to assure that it is conveniently and properly positioned within the mounting means 42, when readied for usage. As can be understood, the proper depth for the cutting blade can be readily determined and obtained through this type of quick adjustment that may be made through the mounting means, for positioning of the cutting blade when located.

As can also be seen in FIG. 15, the cutting blade 43 may include various hardened tips, such as the tungsten or carbide tips 48, with the blade being reversible, vertically, to provide a double edged blade that may be used for a substantial length of time, for both gouging out of the old joint compound, and for refacing of the concrete slot, in preparation for recaulking. Furthermore, the blade may include an aperture, or even a threaded aperture, as at 49, therethrough, for locating of the laterally arranged bolt 44, therethrough, when adjusting the blade into a tightened position, for ready usage This can also be seen in FIG. 6.

It may also be convenient to provide a stub axle, as at 50, expending laterally from one side of the mounting means 42, and which axle may accommodate a wheel 50a, as shown in FIG. 2, to add further support for the mounting means 42, when adjusted into position. A releasable pin, as at 51, may be provided for ease of insertion or removal of such a wheel.

Furthermore, and although it is not shown, there may be other means provided at the vicinity of wheel 50, and which may extend rearwardly of the mounting means 42, and which can deliver and readily apply new joint compound, such as coal tar asphalt, or other rubberized composition, directly into the cleaned and refaced joint, so that the entire oparation can be completed with one pass of the attachment upon the vehicle.

In the preferred embodiment, this particular attachment is useful for mounting upon a Ford or related tractor, such as the Model 12-10, or the Model 12-24. Furthermore, the torsion bar, in the preferred embodiment, has been found desirable if one is used that can absorb pressures up to 750 p.s.i., of twisting or torsional forces.

As also noted in FIG. 6, means may be provided to limit the depth to which the arm means 39 may achieve downward pivot, and this means includes a stop means 52, secured with the frame arm 3, and which incorporates an adjustable screw 53, to provide a lower limit to the pivot of the arm means 39, as can be understood. These are just examples of the application of this invention, in the preferred embodiment, and isolated components, that add to the convenience of usage and operation of this particular attachment.

Variations or modifications to the subject matter of this invention may occur to those skilled in the art upon reviewing the disclosure as made herein. Such variations or modifications, if within the spirit of this invention, are intended to be encompassed within the scope of any claims to patent protection issuing upon this invention. The description of the preferred embodiment as set forth herein is done so for illustrative purposes only.

Having thus described the invention, what is claimed and desired to be secured by Letters Patent is:

1. An attachment for cleaning and refacing concrete joints, said attachment being of the type for mounting upon a tractor comprising, a frame means, said frame means incorporating structure to provide for its mounting to a tractor, a torsion means pivotally supported upon said frame means, said torsion means having a width exceeding the width of said frame means, said torsion means capable of attaining a setting with respect to said frame means, actuation means connecting with said torsion means to attain an adjustment in the torsion means setting as supported by the said frame means, a torsion bar operatively associated within the said torsion means and designed to provide for its limited twisting movement during the attachment's functioning, an arm means operatively associated with the said frame means, a biasing arm secured to said torsion means and also coupling with said arm means for imparting resiliency to it, and a cutting blade attaching to the said arm means and extending substantially downwardly for location within a concrete joint and effecting its cleaning during movement of the tractor and its accompanying attachment.

2. The invention of claim 1 and wherein said torsion means including a cylinder supported upon the said frame means, said cylinder having opposite ends, said torsion bar extending into said cylinder at one end, and connecting within said cylinder at its approximate other end.

3. The invention of claim 2 and wherein said arm means pivotally connected to said frame means and extending rearwardly thereof, said torsion means cylinder and bar pivotally supported upon said frame upwardly of said arm means, said biasing arm extending rearwardly of said frame means and arranged above said arm means, and said biasing arm at its approximate rearward end coupling with said arm means.

4. The invention of claim 3 and wherein said actuation means connecting between said frame means and said torsion means cylinder and when operative providing for pivot to the said torsion means for effecting a raising and lowering of the said cutting blade.

5. The invention of claim 4 and wherein said actuation means comprising a pressure operative cylinder for effecting said torsion means pivot.

6. The invention of claim 5 and wherein said cylinder comprising a hydraulic cylinder.

7. The invention of claim 5 and wherein said cylinder comprising a pneumatic cylinder.

8. The invention of claim 4 and wherein said actuation means comprising a motor means.

9. The invention of claim 4 and including a brace connecting to said frame means, said brace extending therefrom, said actuation means interconnecting between said brace and the torsion means to pivot said torsion means for effecting a raising and lowering of the said cutting blade.

10. The invention of claim 4 and including a mounting means connecting with the arm means at its approximate rearward end, and said mounting means securing said cutting blade for usage.

11. The invention of claim 10 and including at least one shim cooperating with said cutting blade to secure it within the mounting means during usage.

12. The invention of claim 11 and including a pair of adjustment bolts carried by said mounting means for cooperating with at least said one shim for securing said cutting blade during usage.

13. The invention of claim 10 and including a wheel means rotatably mounted upon said mounting means for furnishing support for said arm means and cutting blade during usage.

14. The invention of claim 4 and wherein said cutting blade including at least one of a tungsten tip and carbide tip to sustain its usage.

15. The invention of claim 1 and wherein said torsion means including a cylinder supported upon said frame means, said cylinder having opposite ends, said torsion bar extending into said cylinder at one end, and connecting within said cylinder at its approximate other end, and said torsion bar having a geared connection within said torsion means cylinder.

16. An attachment for cleaning and refacing concrete joints, said attachment being of the type for mounting upon a tractor comprising, a frame means, said frame means incorporating structure to provide for its mounting to a tractor, a torsion means pivotally supported upon said frame means, said torsion means capable of attaining a setting with respect to the said frame means, actuation means connecting with the said torsion means to attain an adjustment in the torsion means setting as supported by the said frame means, said torsion means including a cylinder supported upon the said frame means, said cylinder having opposite ends, a torsion bar operatively associated within the said torsion means and designed to provide for its limited twisting movement during the attachments functioning, said torsion bar extending into said cylinder at one end, and connecting within said cylinder at its approximate other end, an arm means operatively associated with the said frame means, said arm means pivotally connected to said frame means and extending rearwardly thereof, said torsion means cylinder and bar pivotally supported upon said frame means upwardly of said arm means, a biasing arm secured to said torsion means and also coupling with the said arm means for imparting resiliency to it, said biasing arm extending rearwardly of said frame means and arranged above said arm means, and said biasing arm at its approximate rearward end coupling with said arm means, a cutting blade attaching to said arm means and extending substantially downwardly for location within a concrete joint and effecting its cleaning during movement of the tractor and its accompanying attachment, and wherein said torsion bar having a geared connection within said torsion means cylinder.

17. The invention of claim 16 and wherein said torsion bar at its opposite end extending out of said torsion means cylinder.

18. The invention of claim 17 and including a sleeve connecting to the opposite end of said torsion bar, and said biasing arm connecting with said sleeve.

19. The attachment for supporting a cutting blade for cleaning and refacing concrete joints, said attachment being of the type for mounting upon a tractor, comprising, a frame means, said frame means incorporating structure to provide for its mounting to a tractor, a torsion means pivotally supported upon said frame means, said torsion means capable of attaining a setting with respect to said frame means, actuation means connecting with said torsion means to attain an adjustment in the torsion means setting as supported by the said frame means, a torsion bar operatively associated within the said torsion means and designed to provide for its limited twisting movement during the attachment's functioning, said torsion means including a cylinder supported upon the said frame means, said cylinder having opposite ends, said torsion bar extending into said cylinder at one end, and connecting within said cylinder at its approximate other end, and arm means operatively associated with the said frame means, said arm means pivotally connected to said frame means and extending rearwardly thereof, said torsion means cylinder and bar pivotally supported upon said frame means upwardly of said arm means, a biasing arm secured to said torsion means and also coupling with the said arm means for imparting resiliency to it, said biasing arm extending rearwardly of said frame means and arranged above said arm means, said biasing arm at its approximate rearward end coupling with said arm means, said actuation means connecting between said frame means and said torsion means cylinder and when operative providing for pivot to the said torsion means for effecting a raising or lowering of said cutting blade, a brace connecting to said frame means, said brace extending therefrom, said actuation means interconnection between said brace and the torsion means to pivot said torsion means for effecting a raising and lowering of said cutting blade, said brace extending rearwardly from said frame means, the rearward end of said brace including a coupler, said actuation means comprising a pressure operative cylinder, said pressure operative cylinder at one end connecting with said brace coupler, and said pressure operated cylinder at its other end operatively connecting with said torsion means cylinder.

20. The invention of claim 19 and including a lever arm which at one end rigidly connecting with said torsion means cylinder, and said lever arm at its other end pivotally connecting with the pressure operated cylinder.

* * * * *

UNITED STATES PATENT AND TRADEMARK OFFICE

CERTIFICATE OF CORRECTION

PATENT NO. : 4,867,602

DATED : September 19, 1989

INVENTOR(S) : Robert L. Courtoise

It is certified that error appears in the above—identified patent and that said Letters Patent is hereby corrected as shown below:

Column 8, claim 3, line 40, after "frame" and before "up-", add ---means---.

Column 10, claim 19, line 40, change "interconnection" to ---interconnecting---.

Signed and Sealed this

Fourteenth Day of August, 1990

*Attest:*

*Attesting Officer*

HARRY F. MANBECK, JR.

*Commissioner of Patents and Trademarks*